US005353098A

United States Patent [19]

Lim

[11] Patent Number: 5,353,098

[45] Date of Patent: Oct. 4, 1994

[54] IMAGE PRINTING APPARATUS HAVING A ROTATABLE PROTECTIVE COVER FOR A DEVELOPER CARRIER ROLLER THEREIN

[75] Inventor: Young-tac Lim, Seoul, Rep. of Korea

[73] Assignee: SamSung Electronics Co., Ltd., Suwon, Rep. of Korea

[21] Appl. No.: 981,128

[22] Filed: Nov. 24, 1992

[51] Int. Cl.[5] ..... G03G 15/00

[52] U.S. Cl. ..... 355/200; 355/215; 355/245

[58] Field of Search ..... 355/215, 200, 210, 245, 355/246, 250, 251, 253, 259; 118/651, 653, 655, 656, 657, 658, 661

[56] References Cited

U.S. PATENT DOCUMENTS

| | | | |
|---|---|---|---|
| 4,462,677 | 7/1984 | Onoda | 355/210 |
| 4,754,301 | 6/1988 | Kasamura et al. | 355/245 |
| 4,924,267 | 5/1990 | Yoshikawa et al. | 355/210 |
| 4,941,015 | 7/1990 | Komai et al. | 355/215 X |
| 5,061,959 | 10/1991 | Kinoshita et al. | 355/200 X |

FOREIGN PATENT DOCUMENTS

| | | | |
|---|---|---|---|
| 60-101562 | 6/1985 | Japan | 355/245 |
| 62-116969 | 5/1987 | Japan | 355/215 |
| 62-283362 | 12/1987 | Japan | 355/215 |
| 62-283363 | 12/1987 | Japan | 355/215 |

*Primary Examiner*—A. T. Grimley
*Assistant Examiner*—Shuk Y. Lee
*Attorney, Agent, or Firm*—Robert E. Bushnell

[57] ABSTRACT

An image printing apparatus has an upper main body provided with a drum, electrifying apparatus and light-exposure apparatus therein and a lower main body is provided with image-transferring apparatus and a developing apparatus having a developer carrier roller. The upper main body is pivotally detachable from the lower main body. The image printing apparatus is further provided with a protecting cover having a semi-cylindrical body section whose outer surface is formed with a plurality of semicircular protrusions. The protecting cover encloses the upper part of a developer carrier roller of the developing apparatus when the upper main body is detached from the lower main body, so that the protecting cover can prevent foreign matter from entering into the developer carrier roller. Also, the semicircular protrusions facilitate the guidance of the printing paper.

12 Claims, 4 Drawing Sheets

IMAGE PRINTING APPARATUS HAVING A ROTATABLE PROTECTIVE COVER FOR A DEVELOPER CARRIER ROLLER THEREIN

BACKGROUND OF THE INVENTION

The present invention relates to an image printing apparatus, and more particularly to an image printing apparatus in which the inflow of impure matters via the developer carrier roller can be avoided effectively.

Relating to FIG. 1, the conventional image printing apparatus basically comprises two pivotally detachable sections, i.e, an upper main body 1 and a lower main body 1'. A drum 2 is provided in upper main body 1, and an electrifying apparatus 3 for supplying constant charges to the surface of drum 2 is provided on one side of drum 2. A light exposure apparatus 4 for forming an electrostatic latent image on drum 2 by generating local photocurrent corresponding to the image printing signal, is provided next to electrifying apparatus 3. Also, developing apparatus 5 for developing the electrostatic latent image into a visible image by attaching only toner 5*f* except for carrier 5*g* to drum 2 on which the electrostatic latent image has been formed by light exposure apparatus 4, is located in the lower section of drum 2, that is, inside lower main body 1'. In addition, an image-transferring apparatus 6 for transferring the developed electrostatic latent image onto a printing paper P is located opposing drum 2 and on the other side of drum 2. A cleaning apparatus 7 for cleaning toner 5*f* remaining after printing the image is located in the upper section of drum 2, that is, inside upper main body 1. On the other hand, printing paper P onto which the electrostatic latent image is being transferred, is drawn from printing paper dispensing cassette 8 and moved up to the exact transferring position by paper guide plate 9.

In developing apparatus 5, a hopper roller 5*e* is provided to furnish toner 5*f* to the supplying roller 5*d* which is located next to the hopper roller 5*e*. The hopper roller 5*e* also plays the role of toner freezing prevention. Next to the supplying roller 5*d* is located a developer stirring roller 5*c* for electrifying the supplied toner by way of creating friction with the carrier 5*g*. Here, the electrified toner adheres to the carrier to thereby form developer which is then conveyed to the developer carrier roller 5*a* located between developer stirring roller 5*c* and drum 2. Keeping a certain small gap from the upper surface of the developer carrier roller, a developer regulating plate 5*b* is provided to regulate the thickness of the supplied developer on the surface of developer carrier roller 5*a*. At this time, said developing apparatus 5 can be combined with or separated from lower main body 1' of the apparatus.

In the conventional image printing apparatus as detailed above, printing paper P drawn from a printing paper-dispensing cassette 8 and guided by a paper guiding plate 9 passes the surface of drum 2. At the same time, image transferring apparatus 6 transfers the image of the developed electrostatic latent image having been formed on the surface of drum 2 to printing paper P.

However, in the conventional image printing apparatus, the developer carrier roller of developing apparatus is exposed to the outside when the upper main body is pivotally detached from the lower main body, so that foreign particles may thereby enter the apparatus and a user may be polluted with the toner. These foreign particles then become mixed into the developer and inserted between the developer carrier roller and the developer regulating plate to cause the layers of the developer non-uniform, which then causes the undeveloped image such as white lines, etc. in the transferred image on printing paper. Moreover, an additional printing paper guiding plate is necessary for guiding the printing paper to the drum, which results in the unfavorable enlargement of the apparatus and increased installation space, as well as increased manufacturing costs.

SUMMARY OF THE INVENTION

The object of the present invention is to solve the problems caused in the conventional image printing apparatus, so that the inflow of foreign matter and the pollution to the user, when the upper main body is pivotally detached from and attached to lower main body, are prevented by avoiding exposure of the developer carrier roller when an upper main body section is detached from a lower main body section.

In order to accomplish the above object, there is provided an image printing apparatus having an upper main body inside of which a drum, electrifying apparatus, and light-exposure apparatus are located, and a lower main body inside of which are located an image-transferring apparatus and a developing apparatus, the upper main body being pivotally detachable from the lower main body, the image printing apparatus comprising a protecting cover of which a semi-cylindrical main body encloses the upper part of a developer carrier roller of the developing apparatus, and of which the main body has a plurality of semicircular protrusions on its outer circumferential surface, and which is hinge-combined to the developing apparatus to be able to rotate; and rotating means for rotating the protecting cover to selectively protect the developer carrier roller when the upper main body is pivotally attached to and detached from the lower main body.

BRIEF DESCRIPTION OF THE DRAWINGS

The above objects and other advantages of the present invention will become more apparent by describing in detail a preferred embodiment thereof with reference to the attached drawings in which.

DETAILED DESCRIPTION OF THE INVENTION

Figure 1:
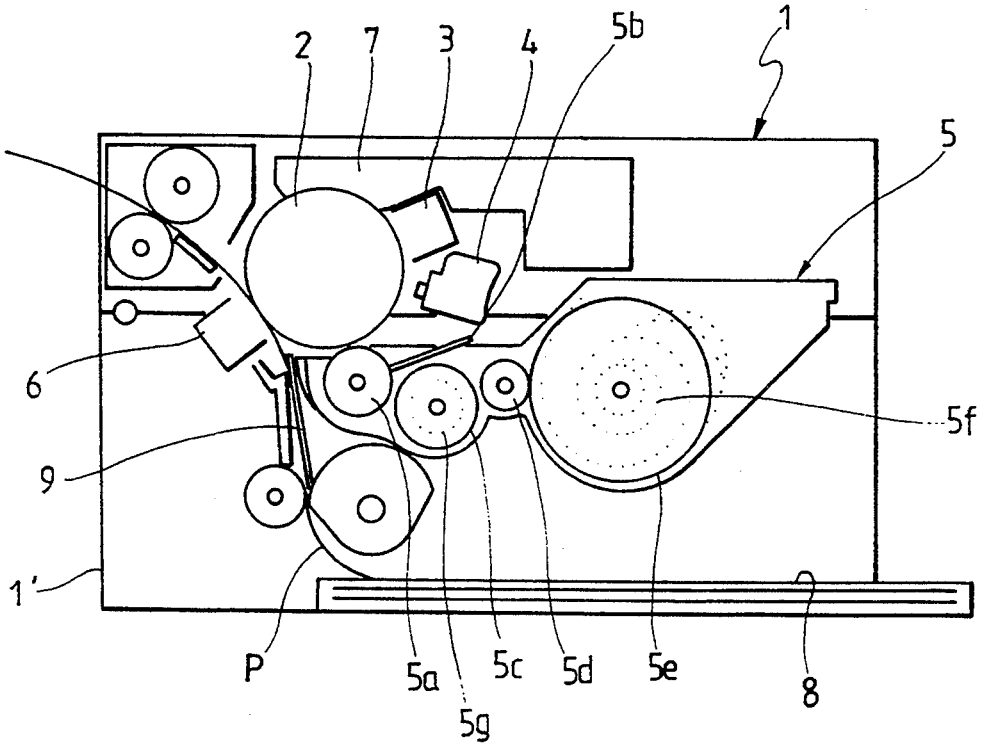
FIG. 1 (PRIOR ART)
FIG. 1 is a schematic side view of a conventional image printing apparatus.
Figure 2:
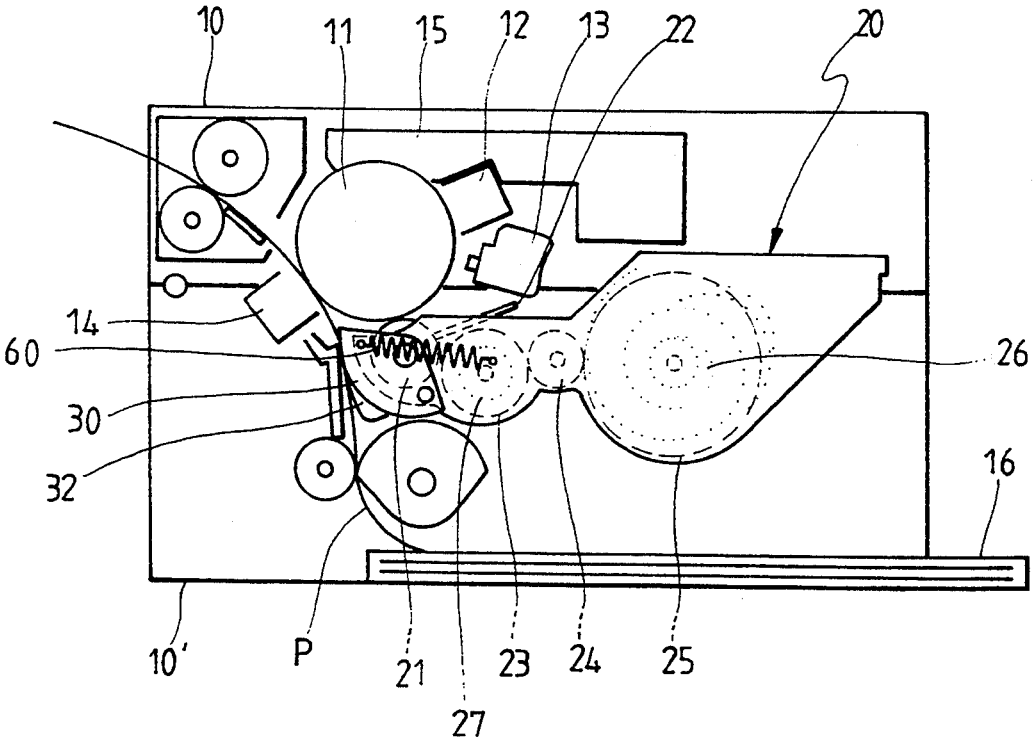
FIG. 2 is a schematic side view of an image printing apparatus according to the present invention.

A preferred example of the embodiment according to the image printing apparatus of this invention will be hereinbelow explained in detail with reference to the attached drawings, FIGS. 2, 3, 4A and 4B.

As shown in the drawings, the image printing apparatus of this invention comprises two pivotally detachable section, i.e. an upper main body 10 and a lower main body 10' which are set up so as to be attached or detached.

A drum 11 is provided inside upper main body 10, and an electrifying apparatus 12 for providing a constant potential to the surface of drum 11 is located to one side thereof. Also, a light-exposure apparatus 13 for forming an electrostatic latent image by generating photocurrent to drum 11, is positioned near electrifying apparatus 12. Further, a developing apparatus 20 for attaching only the toner 26 except for the carrier 27 to the electrostatic latent image formed by light-exposure apparatus 13 to make it visualized, is located under drum 11 and in lower main body 10'. Also, next to the other side of drum 11 is located an image-transferring apparatus 14 for transferring the developed electrostatic latent image onto printing paper P so as to face the drum 11. To the upper part of drum 11 is provided a cleaning apparatus 15 for cleaning toner 26 remaining after printing. On the other hand, printing paper P on which the electrostatic latent image is to be image-transferred is drawn from a printing paper-dispensing cassette 16 and moved upward to the exact image-transferring position.

On the other hand, in developing apparatus 20, a hopper roller 25 is provided to supply toner 26 to the supplying roller 24 which is located next to the hopper roller. The hopper roller 25 also prevents the toner from freezing. Next to the supplying roller 24 is provided a developer stirring roller 23 for electrifying the supplied toner by creating friction with the carrier 27. Here the electrified toner adheres to the carrier, thereby forming developer. The resultant developer is then conveyed to the developer carrier roller 21 located between drum 11 and developer stirring roller 23. A developer regulating plate 22 is also provided near the developer carrier roller to regulate the thickness of the supplied developer on the surface of developer carrier roller 21. Further, developing apparatus 20 is set up so as to be detachable from lower main body 10'. At this point, in developing apparatus 20 according to one feature of the present invention, protecting cover 30 which encloses one side of outer circumferential surface of developer carrier roller 21 and is rotated in a certain radius by means of a certain rotating means, is hinge-combined with developing apparatus 20.

Figure 3:
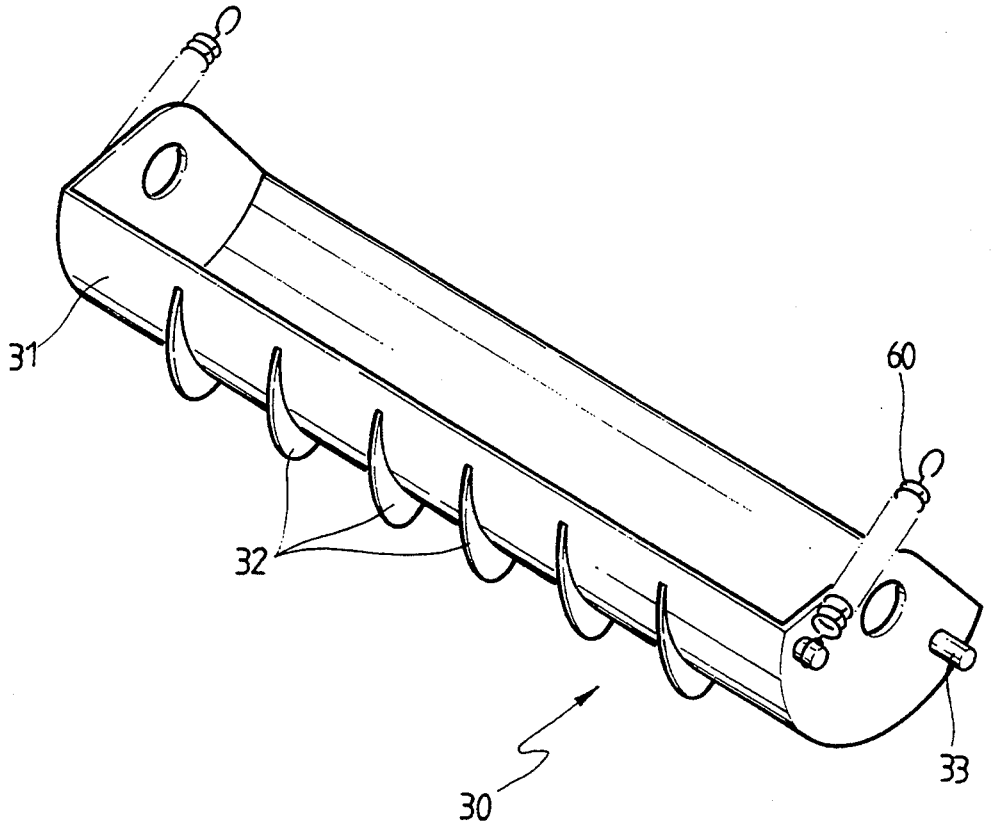
FIG. 3 is an extracted perspective view of a developer carrier roller protecting cover used in the image printing apparatus shown in FIG. 2.

Protecting cover 30 has a semi-cylindrical body section 31 to enclose one side of the outer surface of developer carrier roller 21 as shown in FIG. 3. The section 31 is provided with a plurality of semicircular protrusions 32 by a predetermined distance on its outer surface.

Figure 4A:
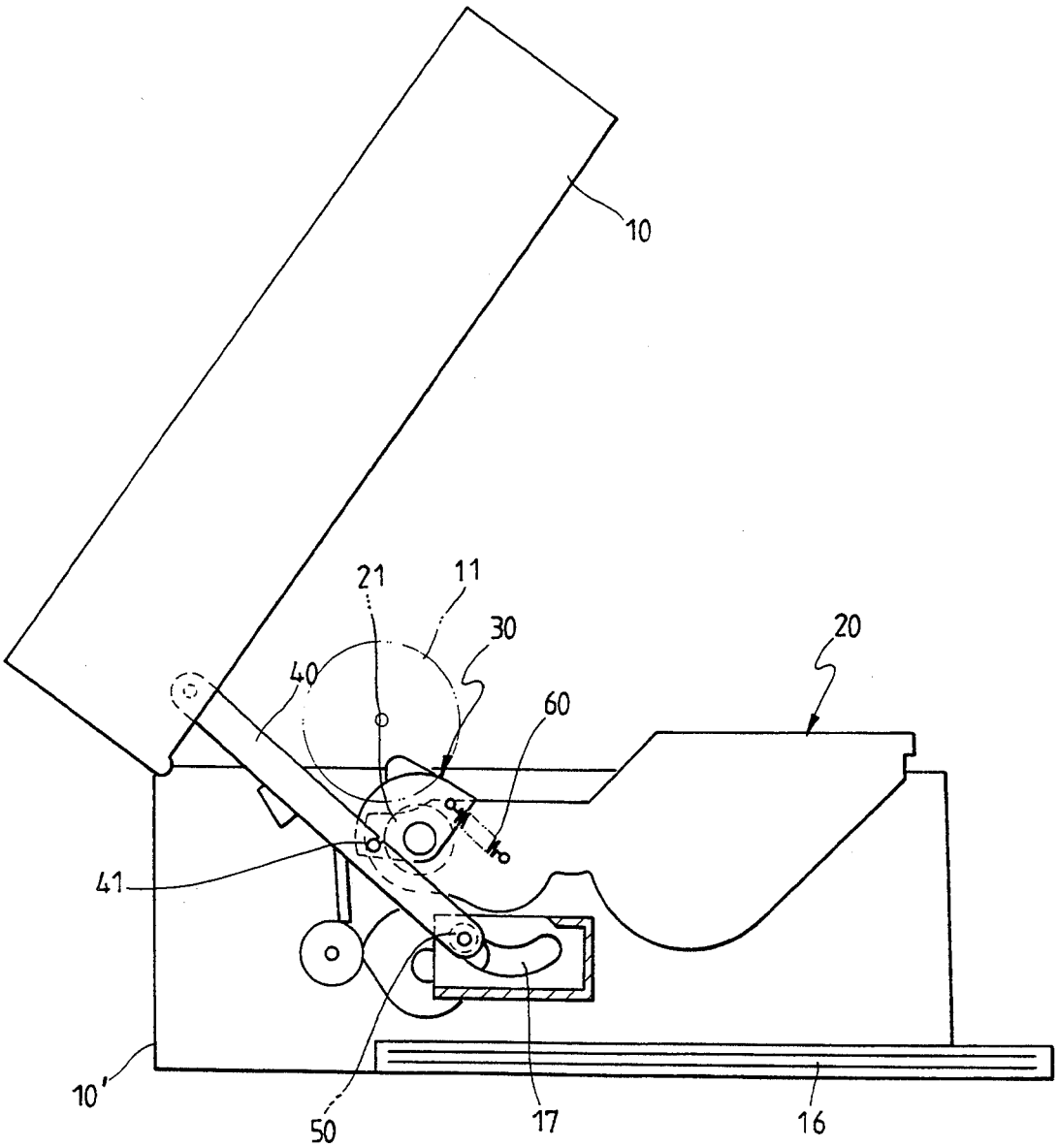
FIGS. 4A and 4B are side views showing the operation of the image printing apparatus according to the present invention.
Figure 4B:
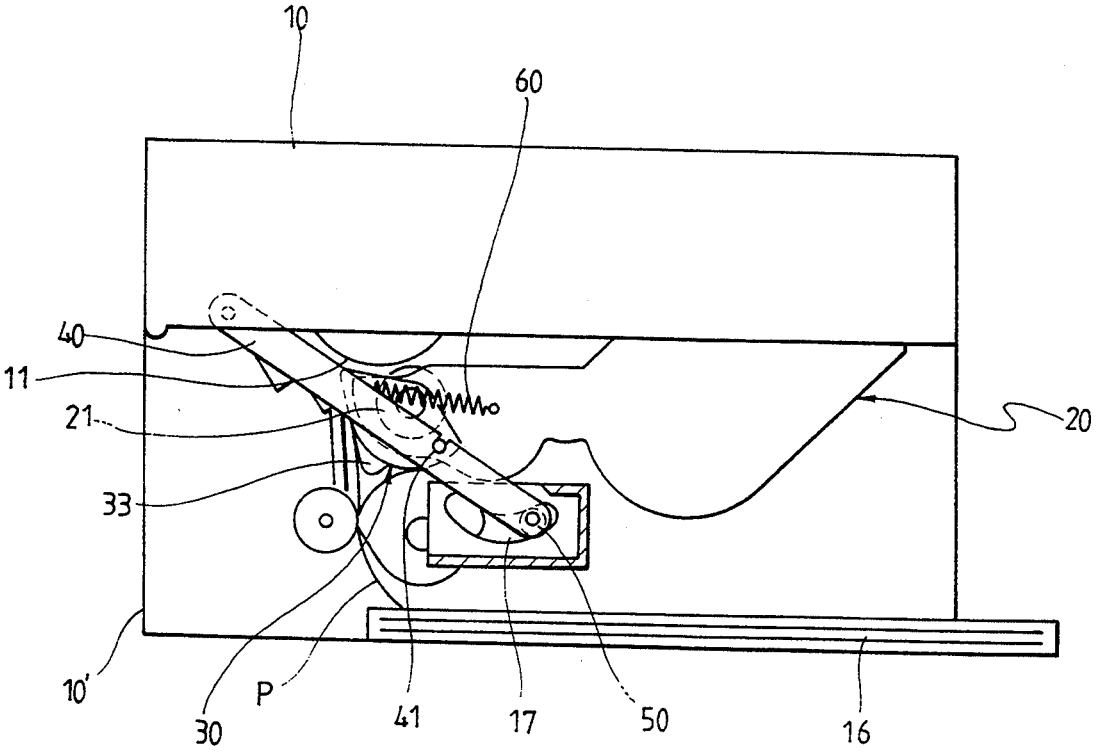

On the other hand, according to the detachment and attachment of upper and lower main bodies 10 and 10', protecting cover 30 is rotated within a certain rotational angle to selectively cover developer carrier roller 21, as shown in FIGS. 4A and 4B. Both sides of protecting cover 30 which is hinge-combined with lower main body 10' have protruding bars 33. Further, protruding bars 33 are inserted in an inserting hole 41 arranged in the center of a guide lever 40 which is pivotally connected with upper main body 10.

At this point, the other end of guide lever 40 is inserted in a guide groove 17 formed on the side of lower main body 10' by interposing a guide roller 50. On the other hand, a spring 60 is fixed between one side of developing apparatus 20 and one side of protecting cover 30, by which protecting cover 30 is elastically biased toward the developing apparatus 20.

In an image printing apparatus constructed as above, printing paper P having been drawn from printing paper-dispensing cassette 16 passes the surface of drum 11, and simultaneously, image-transferring apparatus 14 transfers the developed electrostatic latent image on the surface of drum 11 to the surface of printing paper P. At this time, upper and lower main bodies 10 and 10' are set up so as to be pivotally attached to and detached from each other, as shown in FIGS. 4A and B. Here, when the upper main body is pivotally detached from lower main body or when developing apparatus 20 is detached from lower main body 10', as shown in FIG. 4A, protecting cover 30 encloses developer carrier roller 21 since one end of the protecting cover is fixed and the other end thereof is pulled in a clockwise direction by the tension of spring 60 secured to a point on developing apparatus 20. In the same situation, if developing apparatus 20 is set in lower main body 10' and upper main body 10 becomes combined with lower main body 10', as shown in FIG. 4B, protruding bar 33 provided on the sides of protecting cover 30 moves with guide lever 40 so that developer carrier roller 21 may be exposed.

To explain this operation more in detail, protruding bar 33 is inserted in inserting hole 41 formed in the center of guide lever 40. Guide lever 40 is connected to said upper main body 10 so as to be rotated, and its other end is inserted in guide groove 17 formed on the sides of lower main body 10', so that it can move along guide groove 17. Therefore, the upper main body 10 rotates in a clockwise direction to be combined with lower main body 10', guide lever 40 moves to the right by guide roller 50 along guide groove 17 of lower main body 10', and protruding bar 33 inserted in inserting groove 41 of guide lever 40 rotates in a counter-clockwise direction.

Thus, protecting cover 30 which is hinge-combined with developing apparatus 20 rotates in a counterclockwise direction so that developer carrier roller 21 becomes exposed. On the other hand, when developer carrier roller 21 is exposed by the counter-clockwise rotation of protecting cover 30, a plurality of semicircular protrusions 32 which is provided on the outer circumferential surface is positioned in the proceeding direction of printing paper P that has been drawn from printing paper dispensing cassette 16. Therefore, printing paper P can be guided to the exact image-transferring position, so that an additional paper guide plate is unnecessary.

According to the image printing apparatus of the present invention as described above, the entry of foreign matter onto the developer carrier roller and the contamination of the toner to the user can be prevented by enclosing the developer carrier roller with a protecting cover when upper and lower main bodies are detached from each other. Accordingly, generation of white lines in the image on printing paper due to the entry of foreign obstacles can be avoided. Moreover, a guide plate for guiding the printing paper having been drawn from printing paper dispensing cassette is unnecessary, decreasing manufacturing costs and achieving efficient use of space.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. An image printing apparatus having an upper main body in which a drum, electrifying apparatus, and light-exposure apparatus are provided, and a lower main body in which an image-transferring apparatus and a developing apparatus including a developer carrier roller are provided, said upper main body being pivotally detachable from or attachable to said lower main body, said image printing apparatus comprising:

a protecting cover having a semi-cylindrical body section being hinge-combined on each side thereof with said developing apparatus so as to be rotated for enclosing and exposing an upper part of said developer carrier roller of said developing apparatus; and rotating means for rotating said protecting cover to enclose said upper part of said developer carrier roller to protect said developer carrier roller in response to the pivotal detachment of said upper main body from said lower main body;

said rotating means rotating said protecting cover to expose said upper part of said developer roller, said protecting cover being rotated into a position for guiding printing paper transferred through said image printing apparatus, in response to the pivotal attachment of said upper main body to said lower main body.

2. An image printing apparatus as claimed in claim 1 wherein said rotating means comprises:

a protruding bar provided on each side of said protecting cover;

a guide lever having one end hinge-combined with said upper main body, and another end inserted in a guide groove formed on a side of said lower main body by interposing a guide roller, and a center having an inserting groove for receiving said protruding bar; and a spring having one end secured to said protecting cover and another end secured to said developing apparatus so that said protecting cover is elastically biased toward the developing apparatus.

3. An image printing apparatus as claimed in claim 1 wherein said protecting cover is provided with a plurality of semicircular protrusions on an outer circumferential surface thereof for facilitating the guidance of the printing paper.

4. An image printing apparatus as claimed in claim 2 wherein said protecting cover is provided with a plurality of semicircular protrusions on an outer circumferential surface thereof for facilitating the guidance of the printing paper.

5. An image printing apparatus comprising:

an upper main body hinged to a lower main body, said upper main body being pivotable in a counterclockwise direction to expose a developing apparatus contained in said lower main body;

said upper main body comprising a drum for transferring an image to printing paper;

said lower main body comprising a detachable developing apparatus for supplying toner and for converting said toner into developer;

said developing apparatus comprising a developer carrier roller for transferring said developer to said drum;

a protecting cover having a semi-cylindrical body section being hinge-combined on each side thereof with said developing apparatus so as to be rotated for enclosing or exposing an upper part of said developer carrier roller of said developing apparatus;

a guide lever pivotally attached at one end thereof to said upper main body, the other end of which is slidably connected to a guide groove by interposing a guide roller, said guide groove being formed on a side of said lower main body;

said guide lever having an inserting groove for attaching said guide lever to said protecting cover; said inserting groove being located between each said end of said guide lever.

6. The image printing apparatus as claimed in claim 5, wherein said protecting cover comprises:

a protruding bar for insertion into said inserting groove of said guide lever, wherein said guide lever rotates said protecting cover in a clockwise direction for enclosing said developer carrier roller when said upper main body is pivoted in said counterclockwise direction.

7. The image printing apparatus as claimed in claim 6, wherein said protecting cover further comprises:

a plurality of semicircular protrusions on an outer circumferential surface thereof;

said guide lever rotating said protecting cover in a counterclockwise direction to expose said developer carrier roller to facilitate the transfer of said developer to said drum, said plurality of semicircular protrusions being positioned in a guide path of said printing paper for facilitating the guidance of said printing paper, when said upper main body is pivoted in a clockwise direction.

8. An image printing apparatus comprising:

an upper main body pivotally hinged to a lower main body;

said upper main body comprising a drum for transferring an image to printing paper;

said lower main body comprising a detachable developing apparatus for supplying toner and for converting said toner into developer;

said developing apparatus comprising a developer carrier roller for transferring said developer to said drum;

a protecting cover having a semi-cylindrical body section, said protecting cover being pivotally hinged on each side thereof with said developing apparatus so as to be rotated for enclosing or exposing an upper part of said developer carrier roller;

an elongated guide bar pivotally attached at one end thereof to said upper main body, the other end of which is slidably connected to a guide groove formed on a side of said lower main body;

said elongated guide bar having an inserting hole for attaching said elongated guide bar to said protecting cover; said inserting hole being located between each said end of said elongated guide bar.

9. The image printing apparatus as claimed in claim 8, wherein said protecting cover comprises:

a protruding bar for insertion into said inserting hole to facilitate rotation of said protecting cover, wherein said elongated guide bar rotates said protecting cover in a clockwise direction for enclosing said developer carrier roller when said upper main body is pivoted in a counterclockwise direction.

10. The image printing apparatus as claimed in claim 9, wherein said protecting cover further comprises:

a plurality of semicircular protrusions on an outer circumferential surface of said semi-cylindrical body section;

said elongated guide bar rotating said protecting cover in a counterclockwise direction to expose said developer carrier roller to facilitate the transfer of said developer to said drum, said plurality of semicircular protrusions being positioned in a guide path of said printing paper for facilitating the guidance of said printing paper, when said upper main body is pivoted in a clockwise direction.

11. The image printing apparatus as claimed in claim 10, further comprising a spring one end of which is secured to said protecting cover and the other end of which is secured to said developing apparatus so that said protecting cover is elastically biased toward the developing apparatus.

12. The image printing apparatus as claimed in claim 8, further comprising a paper dispensing cassette disposed in a lower portion of said lower main body for providing said printing paper to a guide path therefor.

* * * * *